US011442397B2

(12) United States Patent
Song et al.

(10) Patent No.: US 11,442,397 B2
(45) Date of Patent: Sep. 13, 2022

(54) WASTE TONER PALLETIZATION DEVICE APPLICABLE TO IMAGE FORMING APPARATUS

(71) Applicant: Hewlett-Packard Development Company, L.P., Spring, TX (US)

(72) Inventors: Jeongchul Song, Suwon (KR); Sanguk Jeon, Suwon (KR); Myung Hee Jang, Pangyo (KR); YoungHoon Han, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,101

(22) PCT Filed: Jul. 17, 2020

(86) PCT No.: PCT/US2020/042522

§ 371 (c)(1),
(2) Date: Jun. 2, 2021

(87) PCT Pub. No.: WO2021/021465

PCT Pub. Date: Feb. 4, 2021

(65) Prior Publication Data

US 2022/0155719 A1 May 19, 2022

(30) Foreign Application Priority Data

Jul. 29, 2019 (KR) ..... 10-2019-0091383

(51) Int. Cl.

| | |
|---|---|
| ***G03G 21/00*** | (2006.01) |
| ***G03G 21/12*** | (2006.01) |
| ***G03G 21/10*** | (2006.01) |

(52) U.S. Cl.
CPC ..... *G03G 21/12* (2013.01); *G03G 21/105* (2013.01)

(58) Field of Classification Search
CPC ..... G03G 21/10; G03G 21/105; G03G 21/12
(Continued)

(56) References Cited

U.S. PATENT DOCUMENTS

| | | | |
|---|---|---|---|
| 3,924,566 | A | 12/1975 | Dennie |
| 5,136,338 | A | 8/1992 | Greenaway et al. |

(Continued)

FOREIGN PATENT DOCUMENTS

| | | |
|---|---|---|
| JP | 1995140871 | 9/1993 |
| JP | 2000029363 | 7/1998 |

(Continued)

*Primary Examiner* — William J Royer
(74) *Attorney, Agent, or Firm* — Jefferson IP Law, LLP

(57) ABSTRACT

An example image forming apparatus includes a printing unit to print an image on a print medium using toner, a container having a hollow portion to accommodate waste toner discharged from the printing unit, a heater to apply heat to the container such that the waste toner becomes a waste toner viscous body, and a piston inserted in the hollow portion of the container movable between a first position blocking a first end portion of the hollow portion, a second position exposing the waste toner viscous body to a second end portion of the hollow portion to cool the waste toner viscous body to become a waste toner pellet, and a third position beyond the second position to separate the waste toner pellet from the second end portion of the hollow portion.

15 Claims, 18 Drawing Sheets

(58) Field of Classification Search
USPC ..... 399/358, 360
See application file for complete search history.

(56) References Cited

U.S. PATENT DOCUMENTS

| | | | | |
|---|---|---|---|---|
| 7,778,586 | B2 | 8/2010 | Meyer et al. | |
| 7,917,077 | B2 | 3/2011 | Shimizu et al. | |
| 2022/0043388 | A1 * | 2/2022 | Fasen | G03G 21/12 |

FOREIGN PATENT DOCUMENTS

| | | | |
|---|---|---|---|
| JP | 2003241609 | | 2/2002 |
| JP | 2004191879 | | 12/2002 |
| JP | 2006187890 | | 12/2004 |
| WO | WO-2021145990 | A1 * | 7/2021 |

* cited by examiner

WASTE TONER PALLETIZATION DEVICE APPLICABLE TO IMAGE FORMING APPARATUS

BACKGROUND

An electrophotographic image forming apparatus supplies toner to an electrostatic latent image formed on a photoconductor to form a visible toner image on the photoconductor. After the toner image is transferred to a print medium, the transferred toner image is fixed on the print medium to print an image on the print medium.

Toner remaining on the photoconductor after the transfer process is removed from the photoconductor. Foreign substances such as dust separated from the print medium may be included in the removed toner. The toner and the foreign substances removed in a printing process are called "waste toner." The waste toner, which may be a powder, is contained in a waste toner container in an image forming apparatus. The waste toner container is periodically replaced.

DETAILED DESCRIPTION OF EXAMPLES

Figure 1:
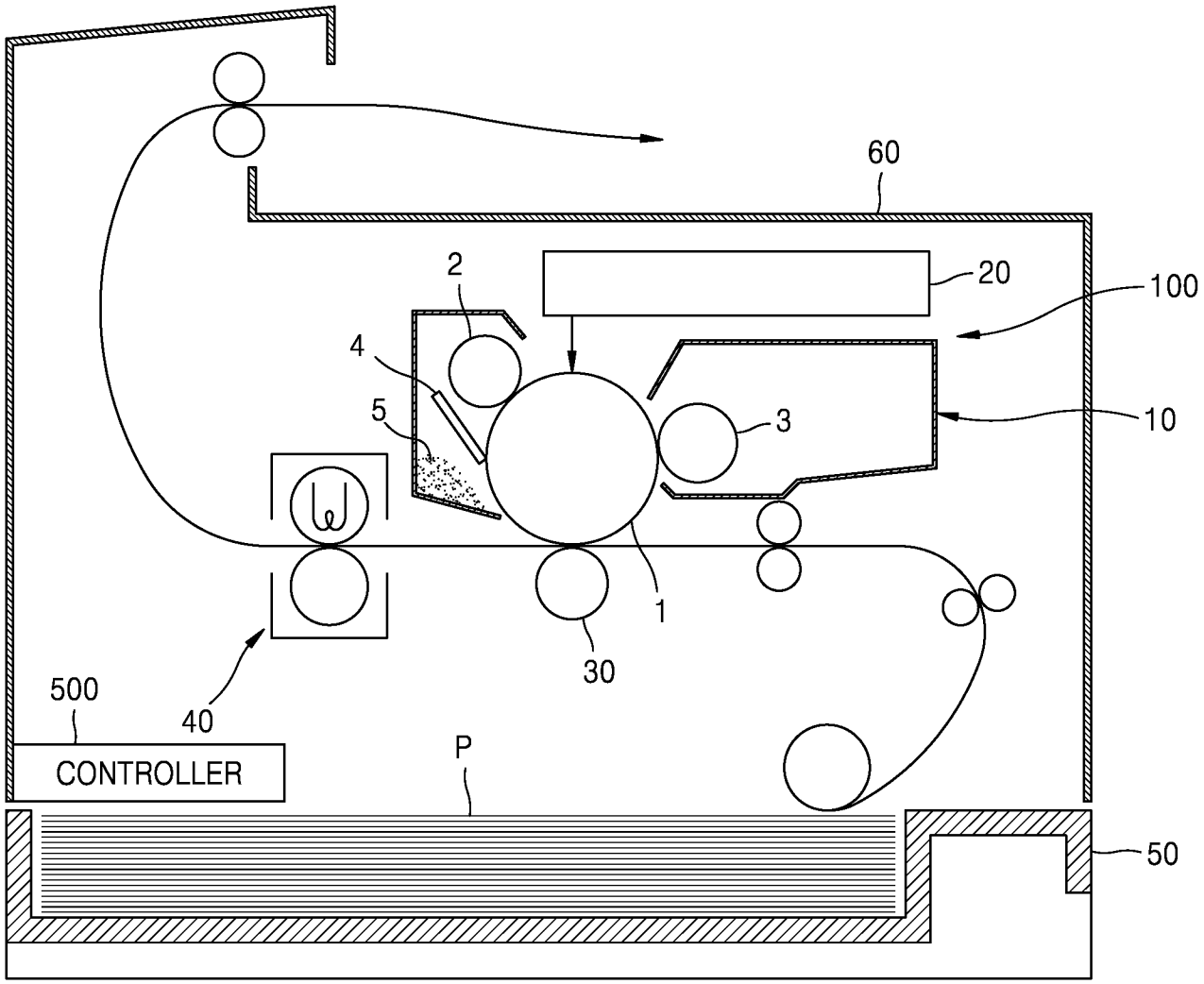
FIG. 1 is a schematic structural diagram of an electrophotographic image forming apparatus according to an example.

Hereinafter, various examples will be described with reference to the drawings. Like reference numerals in the drawings denote like elements, and thus a repetitive description may be omitted.

FIG. 1 is a schematic structural diagram of an electrophotographic image forming apparatus according to an example.

Referring to FIG. 1, an electrophotographic image forming apparatus includes a printing unit 100 that uses toner to print an image on a print medium P. The printing unit 100 prints an image on the print medium P by an electrophotographic method. The printing unit 100 may include a developing device 10, an exposure device 20, a transfer roller 30, and a fuser 40.

The developing device 10 supplies toner contained therein to an electrostatic latent image formed on a photoconductor 1 to develop the electrostatic latent image into a visible toner image. A charging roller 2 charges a surface of the photoconductor 1 to have a uniform electric potential. The exposure device 20 irradiates light modulated in correspondence with image information to the photoconductor 1 and forms the electrostatic latent image on the photoconductor 1.

The developing device 10 may include a developing roller 3. The developing roller 3 faces the photoconductor 1. The developing device 10 may further include a supply roller to supply toner contained inside the developing device 10 to the developing roller 3, a regulating member to regulate the amount of toner attached to a surface of the developing roller 3 and supplied to a developing region where the photoconductor 1 and the developing roller 3 face each other, a stirring member to stir the toner contained in the developing device 10, or the like. A developing bias voltage is applied to the developing roller 3 to attach the toner attached on the surface of the developing roller 3 to the photoconductor 1.

The transfer roller 30 is an example of a transfer unit to transfer a toner image from the photoconductor 1 to the print medium P. The print medium P loaded in a paper feeding portion 50 is transported to an area where the photoconductor 1 and the transfer roller 30 face each other and the toner image is transferred from the photoconductor 1 to the print medium P by a transfer bias voltage applied to the transfer roller 30.

The fuser 40 applies heat and pressure to the toner image transferred to the print medium P to fix the toner image on the print medium P. The print medium P passing through the fuser 40 is discharged to a discharge portion 60.

A cleaning blade 4 is an example of a cleaning unit to remove toner (i.e., waste toner) and foreign substances remaining on the surface of the photoconductor 1 after the transfer process. Other types of cleaning devices, such as a brush, may be used instead of the cleaning blade 4. Waste toner and foreign substances generated in a printing process are collectively called "waste toner." Waste toner may be contained in a waste toner chamber 5 and waste toner may be in the form of a powder.

When the toner has a particle size of 4.8 μm to 6.9 μm and leaks to the outside, the toner may become fine dust floating in the air and may be harmful to humans. Although a replaceable waste toner container (not shown) to receive and contain waste toner from the waste toner chamber 5 may be provided in the image forming apparatus, waste toner may be exposed to the outside in a replacement process. Also, waste toner may contaminate the interior of the image forming apparatus and may contaminate the indoor air.

To reduce contamination of the interior and exterior of the image forming apparatus by waste toner, a method of pelletizing waste toner into pellets is considered. Hereinafter, an example of a simple and compact waste toner pelletization device as used in an image forming apparatus will be described.

Figure 2:
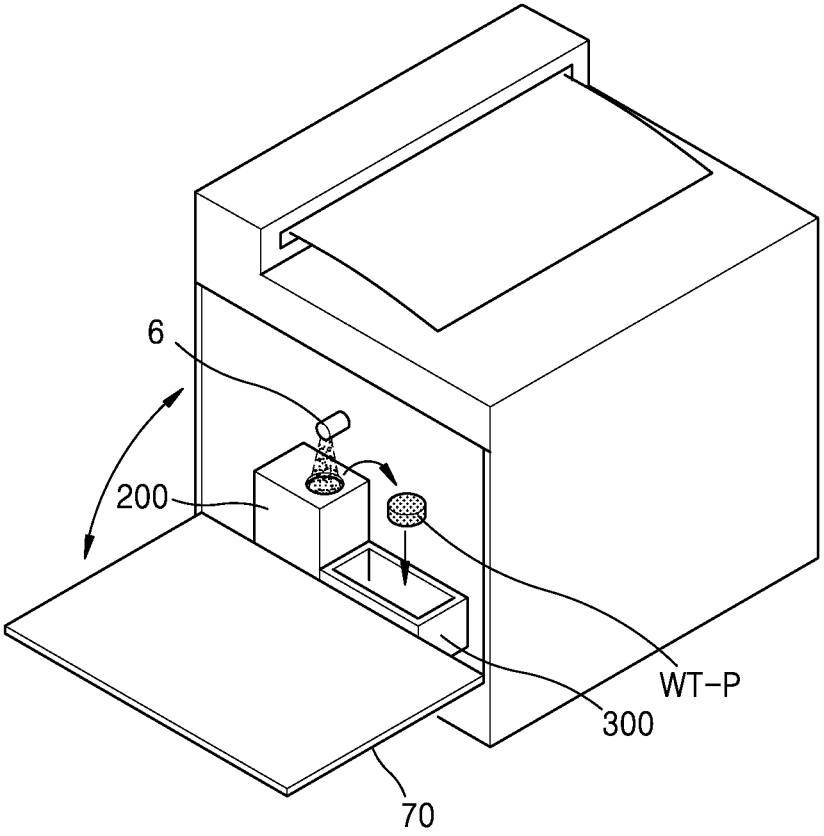
FIG. 2 is a perspective view of an electrophotographic image forming apparatus according to an example.

FIG. 2 is a perspective view of an electrophotographic image forming apparatus according to an example.

Referring to FIG. 2, a waste toner pelletization device 200 is shown. The waste toner pelletization device 200 may have a size that may be installed in a space where a replaceable waste toner container (not shown) is mounted. Waste toner contained in the waste toner chamber 5 is discharged from the waste toner chamber 5 through a waste toner outlet 6 by a conveying unit (not shown). Discharged waste toner is formed into a pellet by the waste toner pelletization device 200 and a waste toner pellet WT-P may be contained in, for example, in a pellet container 300. For example, a user may open a door 70 to open a front portion of the image forming apparatus and remove the pellet container 300. After discarding the waste toner pellet WT-P collected in the pellet container 300, the pellet container 300 may be mounted on the image forming apparatus again.

Figure 3:
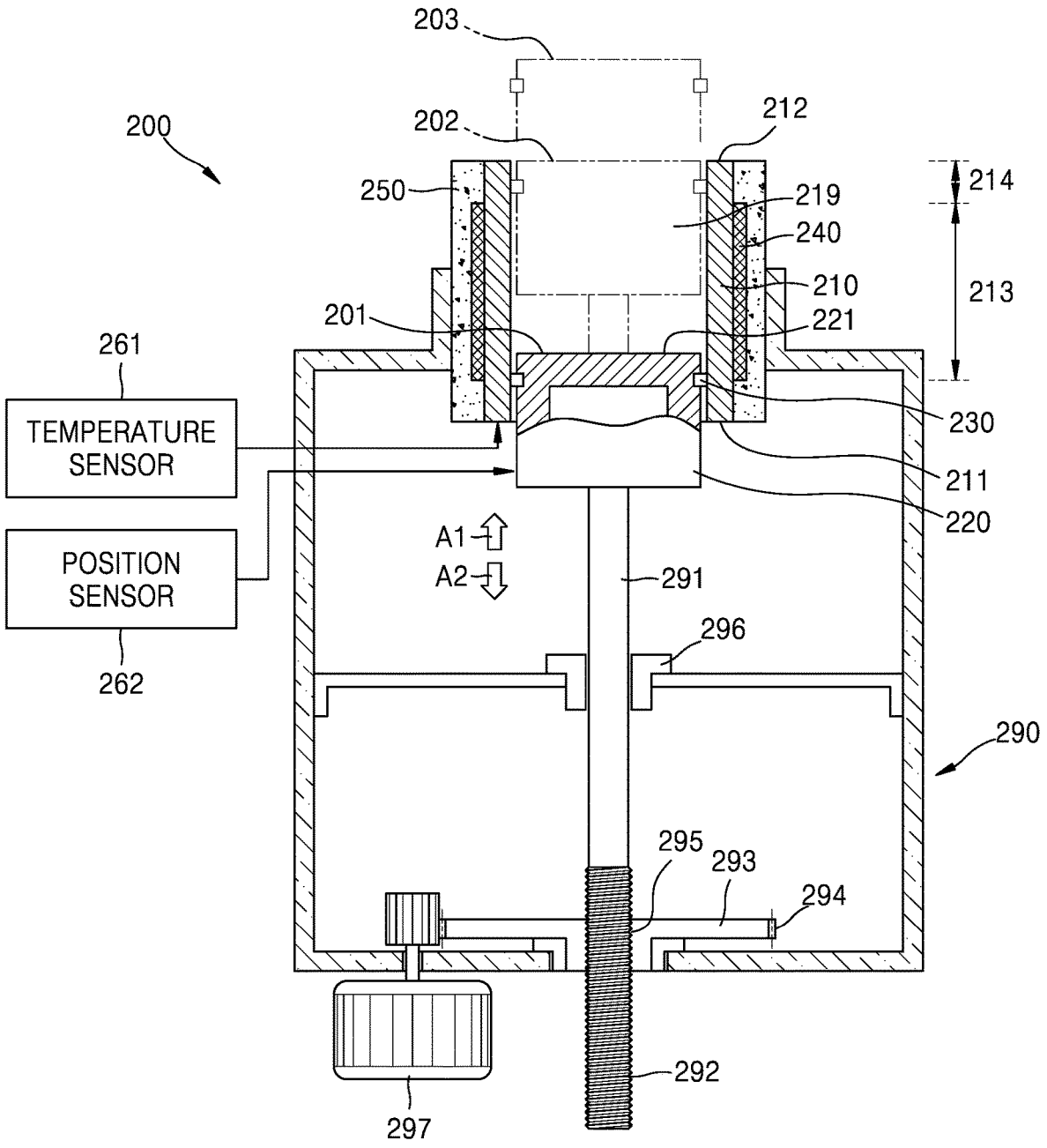
FIG. 3 is a schematic structural diagram of a waste toner pelletization device according to an example.

FIG. 3 is a schematic structural diagram of a waste toner pelletization device 200 according to an example.

Referring to FIG. 3, the waste toner pelletization device 200 may include a container 210 having a hollow portion 219 to contain waste toner, a heater 240 to apply heat to the container 210 such that waste toner contained in the hollow portion 219 becomes a waste toner viscous body, and a piston 220 inserted to be movable in the hollow portion 219. The piston 220 may be moved between a first position 201 blocking a first end portion 211 of the hollow portion 219, a second position 202 exposing the waste toner viscous body to a second end portion 212 of the hollow portion 219 to cool the waste toner viscous body to become the waste toner pellet, and a third position 203 beyond the second end portion 212 of the hollow portion 219 to separate the waste toner pellet from the second end portion 212 of the hollow portion 219. A driving unit 290 drives the piston 220 in a longitudinal direction of the hollow portion 219 to move between the first position 201, the second position 202, and the third position 203.

The container 210 may have a hollow-cylinder shape. In the illustrated example, the cross-sectional shape of the hollow portion 219 is circular. However, the cross-sectional shape of the hollow portion 219 may vary. For example, the cross-sectional shape of the hollow portion 219 may be a polygonal shape. In this case, the corners of the polygon may have a round shape to prevent waste toner from leaking through the corners of the polygon.

The container 210 may include a metal material having high thermal conductivity such that the heat of the heater 240 may be easily transferred to the waste toner contained inside the container 210. A heat resistant release layer may be provided on the inner wall of the hollow portion 219 to prevent adhesion of the heated waste toner having viscosity or pelletized waste toner. The heat resistant release layer may include, for example, a perfluoroalkoxy (PFA) resin, a polytetrafluoroethylene (PTEF) resin, or the like.

The heater 240 applies heat to the container 210. The heater 240 may be arranged to surround the outer wall of the container 210. For example, a resistance coil, a heat source in a form of a flexible sheet, or the like may be used as the heater 240. The waste toner pelletization device 200 may include a temperature sensor 261 to sense the temperature of the container 210. The temperature sensor 261 may be, for example, a contact-type temperature sensor such as a thermistor or the like in contact with the outer wall of the container 210. A heat insulating member 250 may be provided on the outside of the heater 240 to reduce heat loss of the heater 240. The heat insulating member 250 may cover the heater 240. The heat insulating member 250 may include a heat resistant material having low thermal conductivity. In an example, the heat insulating member 250 may include a polyethylene terephthalate (PET) resin containing glass fibers.

The container 210 may include a heating region 213, in which the heater 240 is installed, and a non-heating region 214, which is near the second end portion 212, in which the heater 240 is not installed. As described below, the waste toner viscous body is cooled outside the hollow portion 219. In this case, the waste toner viscous body is in contact with the second end portion 212. As the vicinity of the second end portion 212 is made as the non-heating region 214, the time required for the waste toner viscous body to cool down to the waste toner pellet may be reduced.

A controller (e.g., 500 in FIG. 1) may control the heater 240 to heat the waste toner contained in the hollow portion 219 above the glass transition temperature Tg of the toner. The controller 500 may control the heater 240 such that a heating temperature T of the heater 240 does not exceed the heat resistance limit temperature Th of the heat insulating member 250. In other words, the controller 500 may control the heater 240 based on a detection signal of the temperature sensor 261 such that the heating temperature T of the heater 240 satisfies a condition of $Tg<T<Th$.

A head surface 221 of the piston 220 is in contact with waste toner, the waste toner viscous body, and the waste toner pellet. A release coating layer may be formed on the head surface 221 of the piston 220 to facilitate separation from the waste toner, the waste toner viscous body, and the waste toner pellet. The release coating layer may be formed by coating a heat resistant resin having a release property on the head surface 221 of the piston 220. The heat resistant resin having a release property may include, for example, a PFA resin, a PTEF resin, or the like. The waste toner pelletization device 200 may include a sealing member 230. The sealing member 230 may be installed in the piston 220 to prevent leakage of waste toner through a gap between the piston 220 and the inner wall of the hollow portion 219. The sealing member 230 may be, for example, a ring-shaped member coupled to the piston 220. The sealing member 230 may include a material having elasticity and releasability. The sealing member 230 may include, for example, a PTEF resin or the like.

An upper end portion of the piston 220 may include a releasable elastic body such that the upper end portion including the head surface 221 of the piston 220 may be in close contact with the inner wall of the hollow portion 219 without a gap. The releasable elastic body may include, for example, a PFA resin, a PTEF resin, or the like. In other words, the upper end portion of the piston 220 may be integrally formed with the sealing member 230 with a material having elasticity and releasability. In this case, the sealing member 230 may not be used.

As described above, the piston 220 may be moved between the first position 201, the second position 202, and the third position 203. The driving unit 290 may move the piston 220 between the first position 201, the second position 202, and the third position 203. FIG. 3 illustrates an example of the driving unit 290. A rod 291 is connected to the piston 220. The rod 291 extends in a moving direction of the piston 220. The rod 291 is supported by a supporting unit 296. A male screw portion 292 is provided on an end portion of the rod 291. A rotating member 293 includes a female screw portion 295 that engages with the male screw portion 292. The rotating member 293 is rotated by a motor 297 in a fixed position. For example, a gear portion 294 is provided at the rotating member 293 and the motor 297 is power-connected to the gear portion 294.

According to the above structure, when the motor 297 is rotated in a first direction (e.g., clockwise), the rotating member 293 rotates forward at a fixed position. The rod 291 may be moved in an A1 direction and the piston 220 may be moved between the first position 201, the second position 202, and the third position 203. When the motor 297 is rotated in a second direction (e.g., counterclockwise), the rotating member 293 rotates backward at a fixed position. The rod 291 may be moved in an A2 direction and the piston 220 may be moved between the third position 203, the second position 202, and the first position 201.

The driving unit 290 shown in FIG. 3 is an example and the driving unit 290 may have various structures such as a structure moving the piston 220 by using a linear actuator.

The waste toner pelletization device 200 may include a position sensor 262 to sense a position of the piston 220. The position sensor 262 may detect, for example, the first position 201 of the piston 220 as a reference position, and the second position 202 and the third position 203 may be detected from the driving time and the number of driving pulses of the motor 297, or the like based on the reference position. The controller 500 may control the motor 297 to move the piston 220 between the first position 201, the second position 202, and the third position 203 based on a detection signal of the position sensor 262.

The waste toner pelletization device 200 may be installed in a vertical direction. The second end portion 212 of the hollow portion 219 may face the waste toner outlet 6. In that case, waste toner discharged through the waste toner outlet 6 flows into the hollow portion 219.

FIGS. 4A to 4F are diagrams illustrating a waste toner pelletization method using the waste toner pelletization device 200 shown in FIG. 3 according to an example. Referring to FIGS. 3 and 4A to 4F, an example of a waste toner pelletization method will be described.

An example waste toner pelletization method may include accommodating waste toner in the hollow portion 219 of the container 210, forming a waste toner viscous body by heating the waste toner in the hollow portion 219, forming a waste toner pellet by cooling the waste toner viscous body, and discharging the waste toner pellet. The discharging of the waste toner pellet may include separating the waste toner pellet from the second end portion 212 of the container 210, separating the waste toner pellet from the head surface of the piston 220, and discharging the waste toner pellet to the outside of the container 210.

Figure 4A:
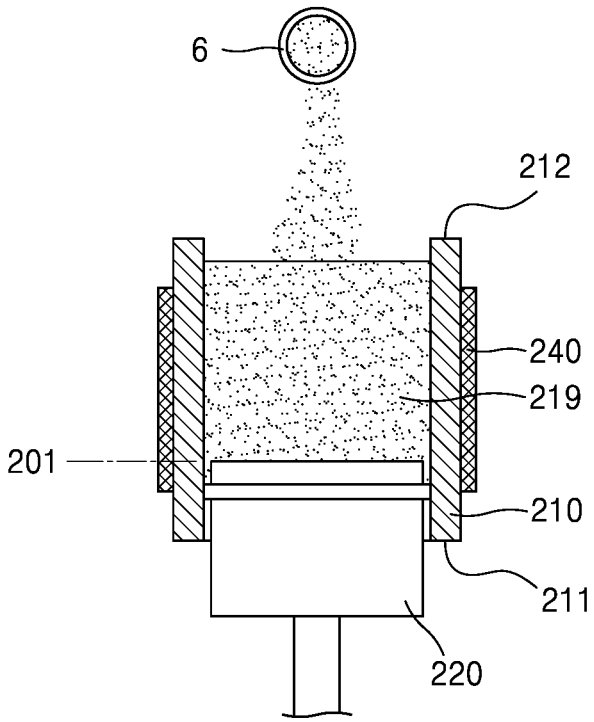
FIGS. 4A to 4F are diagrams illustrating a waste toner pelletization method using the waste toner pelletization device shown in FIG. 3 according to an example.

FIG. 4A illustrates an example of accommodating of the waste toner in the hollow portion 219 of the container 210. Referring to FIG. 4A, the accommodating of the waste toner in the hollow portion 219 of the container 210 may include positioning the piston 220 at the first position 201 adjacent to the first end portion 211 of the hollow portion 219 of the container 210 and accommodating waste toner discharged from the printing unit 100 in the hollow portion 219 of the container 210.

The controller 500 drives the motor 297 to position the piston 220 in the first position 201. The piston 220 is positioned adjacent to the first end portion 211 of the hollow portion 219 at the first position 201 to block the first end portion 211 of the hollow portion 219 and form a bottom of the hollow portion 219. The second end portion 212 of the hollow portion 219 is positioned below the waste toner outlet 6. Waste toner discharged from the waste toner outlet 6 is dropped into the hollow portion 219 through the second end portion 212 by gravity and is accommodated in the hollow portion 219.

Figure 4B:
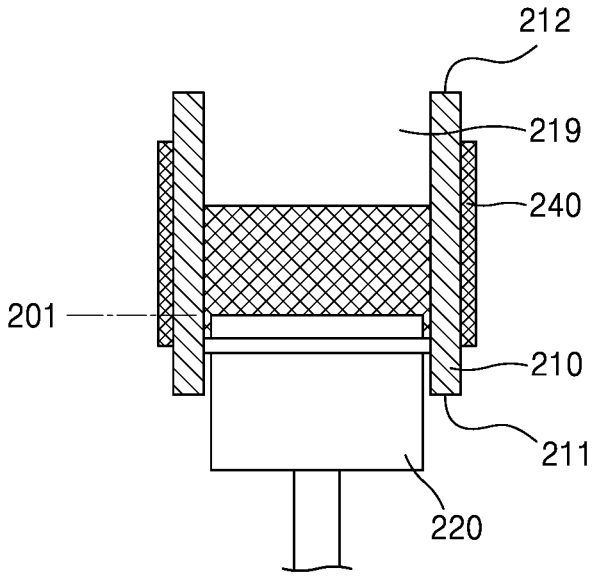

FIG. 4B illustrates the forming of the waste toner viscous body by heating the waste toner. The controller 500 heats the container 210 by using the heater 240. Heat is transferred to the waste toner, and the waste toner is heated. When the temperature of the waste toner rises above the glass transition temperature Tg, the waste toner viscous body becomes viscous and particles of the waste toner bind together to form the waste toner viscous body. The volume of the waste toner viscous body may be less than the volume of the waste toner.

Figure 4C:
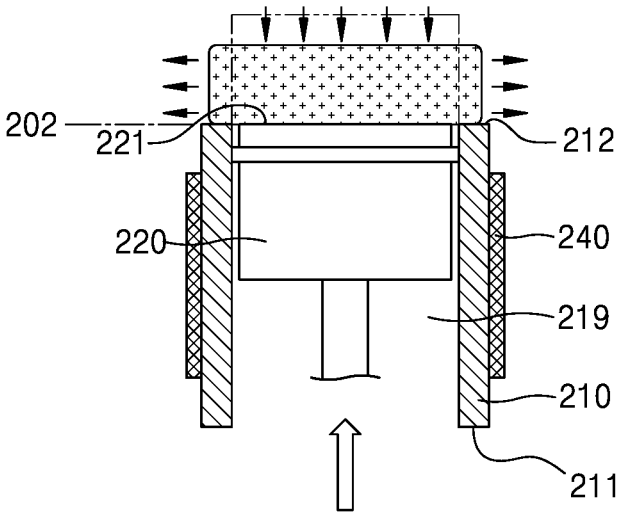

FIG. 4C illustrates the forming of the waste toner pellet by cooling the waste toner viscous body. The forming of the waste toner pellet by cooling the waste toner viscous body may include moving the piston 220 to the second position 202 to support the waste toner viscous body at the second end portion 212 of the hollow portion 219 and cooling the waste toner viscous body to form the waste toner pellet.

The controller 500 may drive the motor 297 to move the piston 220 to the second position 202 such that the waste toner viscous body is exposed to the outside of the hollow portion 219 through the second end portion 212 of the hollow portion 219.

The waste toner viscous body may be attached to the inner wall of the hollow portion 219 by viscosity. In this state, shear stress is generated in the waste toner viscous body when the piston 220 is moved. In a structure in which the piston 220 pulls the waste toner viscous body downward to discharge the waste toner viscous body, when the piston 220 is moved, the shear stress functions as tension on the waste toner viscous body and the waste toner viscous body expands and remains inside the container 210. According to the waste toner pelletization device 200 of the present example, in which the piston 220 pushes the waste toner viscous body while being moved from the first position 201 toward the second position 202, the shear stress functions as a force compressing the waste toner viscous body. Accordingly, even when a separate mechanical structure configured to compress the waste toner viscous body is not used, the waste toner viscous body may be compressed and stably pushed to the outside of the container 210.

When the piston 220 reaches the second position 202, the waste toner viscous body is exposed to the outside of the container 210. As shown in FIG. 4C, due to the influence of expansion of the air inside the waste toner viscous body and gravity, the waste toner viscous body is slightly spread outward and supported by the second end portion 212 beyond the head surface 221 of the piston 220. The second position 202 of the piston 220 is determined such that the waste toner viscous body may be supported by the head surface 221 of the piston 220 and the second end portion 212 of the hollow portion 219. The head surface 221 of the piston 220 in the second position 202 may be parallel to the second end portion 212 of the hollow portion 219 and may slightly protrude more outward than the second end portion 212 of the hollow portion 219. In this state, the waste toner viscous body is cooled for a predetermined cooling time. As the waste toner viscous body solidifies, the waste toner viscous body becomes the waste toner pellet. The cooling may be performed using an air-cooled method.

Heating conditions and cooling conditions may be determined to stably discharge the waste toner pellet from the waste toner pelletization device, while minimizing the time for a pelletization process. For example, the heating temperature T may be set to minimize the time required, including the heating time to form the waste toner viscous body and the cooling time to cool the waste toner viscous body to form the waste toner pellet, and stably separate the waste toner pellet from the container 210 and the piston 220.

Table 1 shows an example of results of checking the pelletization of the waste toner viscous body and separability of the waste toner pellet while changing the heating temperature T, the heating time, and the cooling time.

TABLE 1

| | Heating temperature (° C.) | Heating time (sec) | Cooling time (sec) | Pellet-ization | Separability |
|---|---|---|---|---|---|
| case 1 | 120 | 90 | 120 | OK | OK |
| case 2 | 120 | 90 | 90 | OK | OK |
| case 3 | 120 | 90 | 60 | OK | NG |
| case 4 | 120 | 60 | — | NG | — |
| case 5 | 150 | 60 | 120 | OK | NG |
| case 6 | 150 | 40 | — | NG | — |
| case 7 | 150 | 60 | 150 | OK | NG |
| case 8 | 100 | 90 | — | NG | — |
| case 9 | 100 | 180 | — | NG | — |

Referring to Table 1, when the heating temperature T is 100° C., a waste toner viscous body is not formed even after heating for about 180 seconds. When the heating temperature T is 150° C., a waste toner viscous body is formed by heating about 60 seconds. However, the viscosity of the waste toner viscous body was very low such that the separability was not ensured after cooling. When the heating temperature T is 120° C., a waste toner viscous body may be formed by heating for about 90 seconds, and good separability may be ensured by properly selecting a cooling time. In an example, the heating temperature T is set to 120° C., and each of the heating time and the cooling time is set to 90 seconds.

To push the waste toner viscous body to the outside of the container 210, a force applied to the piston 220 by the motor 297 should be greater than an adhesion force between the waste toner viscous body and the inner wall of the hollow portion 219. Table 2 shows the adhesion force between the waste toner viscous body and the inner wall of the hollow portion 219 in accordance with the temperature of the inner wall of the hollow portion 219. The diameter and height of the hollow portion 219 are respectively 13.5 mm and 42 mm, and a PTFE layer is formed on the inner wall of the hollow portion 219. The glass transition temperature Tg of the toner is 55° C. to 60° C., and the stroke of the piston 220 to discharge the waste toner viscous body is 21 mm. A maximum value of a driving force of the motor 297 is 5.5 kgf.

TABLE 2

| Temperature | ambient | 50° C. | 65° C. | 80° C. |
|---|---|---|---|---|
| Adhesion force (kgf) | 13.28 | 3.41 | 0.35 | 0.32 |

As shown in Table 2, when the temperature of the inner wall of the hollow portion 219 is greater than the glass transition temperature Tg, the adhesion force decreases. Under a condition of the heating temperature T greater than the glass transition temperature Tg, the waste toner viscous body may be easily pushed to the outside. Accordingly, the time for a pelletization process may be reduced by discharging the waste toner viscous body to the outside of the container 210 immediately after the heating process.

In addition, the container 210 is surrounded by the heat insulating member 250 to prevent heat loss of the heater 240. Accordingly, the cooling of the waste toner viscous body inside the hollow portion 219 may take a long time. For example, according to an experiment, the cooling of the waste toner viscous body inside the hollow portion 219 to 80° C., 60° C., 40° C., and ambient temperature respectively took 300 seconds, 470 seconds, 820 seconds, and 2100 seconds. Therefore, it is preferable in terms of cooling time to expose the waste toner viscous body to the outside of the container 210 to cool down.

The cooling time may be reduced as the temperature of a member in contact with the waste toner viscous body decreases. The waste toner viscous body is in contact with the second end portion 212 of the container 210. As the temperature of the second end portion 212 of the container 210 is low, the cooling time may be reduced. As shown in FIG. 3, the cooling time may be reduced by forming the non-heating region 214 in which the heater 240 is not installed in a position adjacent to the second end portion 212 of the container 210.

Figure 4D:
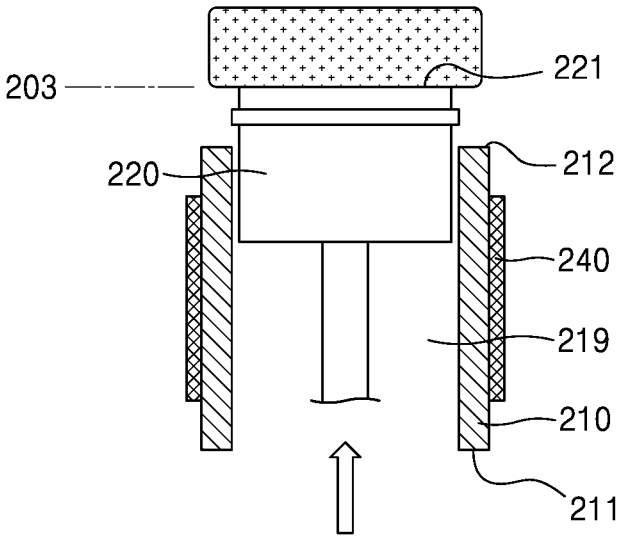
Figure 4E:
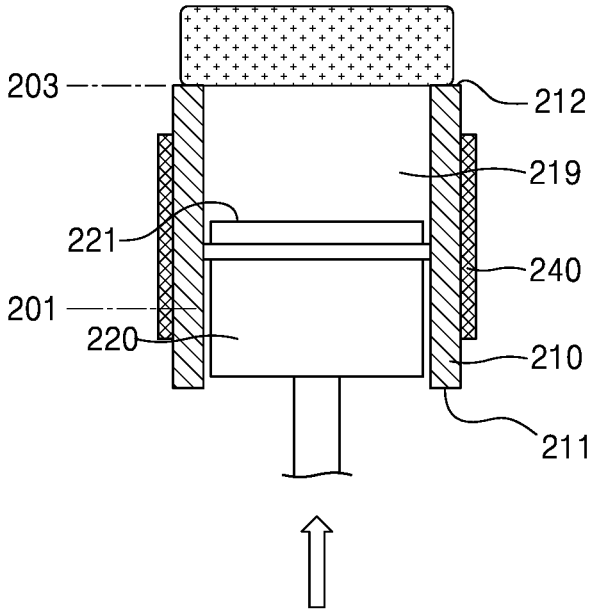
Figure 4F:
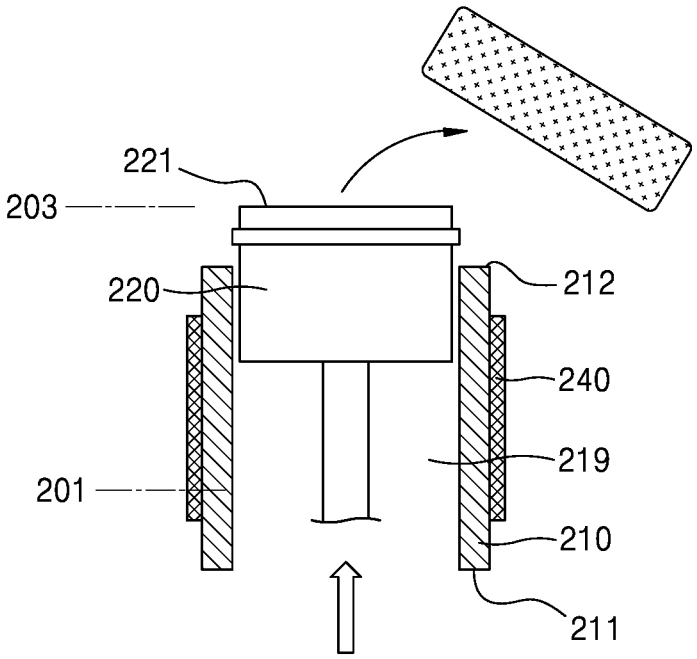

The waste toner pellet is attached to the head surface 221 of the piston 220 and the second end portion 212 of the hollow portion 219. FIGS. 4D, 4E, and 4F show the discharging of the waste toner pellet.

The discharging of the waste toner pellet may include moving the piston 220 toward the third position 203 beyond the second end portion 212 of the hollow portion 219 to separate the waste toner pellet from the second end portion 212, moving the piston 220 from the third position 203 toward the first position 201 through the second position 202 to separate the waste toner pellet from the head surface 221 of the piston 220, and discharging the waste toner pellet out of the container 210 by moving the piston 220 to a position beyond the second end portion 212.

The waste toner pellet is separated from the second end portion 212 of the container 210. To this end, the controller 500 drives the motor 297 to move the piston 220 toward the third position 203 beyond the second end portion 212 of the container 210. As shown in FIG. 4D, the waste toner pellet is separated from the second end portion 212 of the container 210 and moved together with the piston 220. In this state, the waste toner pellet is attached to the head surface 221 of the piston 220.

The waste toner pellet is separated from the head surface 221 of the piston 220. To this end, the controller 500 drives the motor 297 to move the piston 220 from the third position 203 toward the first position 201 through the second position 202. When the piston 220 reaches the second position 202, the waste toner pellet is caught in the second end portion 212 of the container 210. In this state, when the piston 220 is moved toward the first position 201, the waste toner pellet remains in a state caught by the second end portion 212 of the container 210. Accordingly, as shown in FIG. 4E, the waste toner pellet is separated from the head surface 221 of the piston 220. The piston 220 may be moved to the first position 201 and may be moved to a predetermined position between the first position 201 and the second position 202.

The waste toner pellet is discharged to the outside of the container 210. The controller 500 drives the motor 297 to move the piston 220 again to the position beyond the second end portion 212 of the container 210. When the piston 220 passes through the second position 202, the waste toner pellet is pushed by the piston 220 and falls out of the container 210. A moving position of the piston 220 to discharge the waste toner pellet may be determined beyond the second end portion 212 of the container 210 such that the waste toner pellet may fall out of the container 210. The moving position of the piston 220 to discharge the waste toner pellet may be the third position 203, a position lower than the third position 203, or a position beyond the third position 203.

According to the waste toner pelletization device 200 of the present example, the waste toner pellet may be separated and discharged from the container 210 by a reciprocating movement of the piston 220. Therefore, a waste toner pelletization device having a simple structure may be implemented. The waste toner pelletization device 200 may replace an existing replaceable waste toner container and may increase the eco-friendliness and user convenience of the image forming apparatus as an office device. By reducing waste toner from leaking in a form of fine dust, contamination of indoor air due to the use of the image forming apparatus may be reduced, and the image forming apparatus may be kept clean. In addition, since the waste toner is plastic in a pellet state instead of a fine particle, the user may more easily remove the waste toner. Accordingly, since the regular replacement of the waste toner container is not needed, maintenance costs may be reduced for the user and the burden of providing after-sales service may be reduced for the manufacturer. In addition, since the user may frequently remove the pelletized waste toner pellet, the pellet container 300 having a small storage capacity may be used. Therefore, as the internal space of the image forming apparatus may be efficiently used, the freedom of design of the image forming apparatus may be improved.

Figure 5:
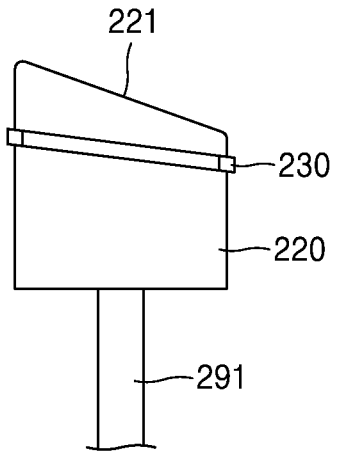
FIG. 5 is a side view of a piston according to an example.

FIG. 5 is a side view of a piston 220 according to an example.

Referring to FIG. 5, the head surface 221 of the piston 220 may incline with respect to the moving direction of the piston 220. According to the above structure, during the discharge of the waste toner pellet to the outside of the container 210, when the piston 220 exceeds the second end portion 212 of the container 210, the waste toner pellet may more easily slide from the inclined head surface 221 of the piston 220 and fall out of the container 210.

The waste toner pellet may fall into the pellet container 300 provided in the image forming apparatus, as shown in FIG. 2. The user may separate the pellet container 300 from the image forming apparatus to discard the waste toner pellet, and remount the pellet container 300 to the image forming apparatus. By converting waste toner into the waste toner pellet, contamination of the inside and outside of the image forming apparatus by waste toner may be reduced or prevented and the user's convenience of handling waste toner may be improved.

Figure 6:
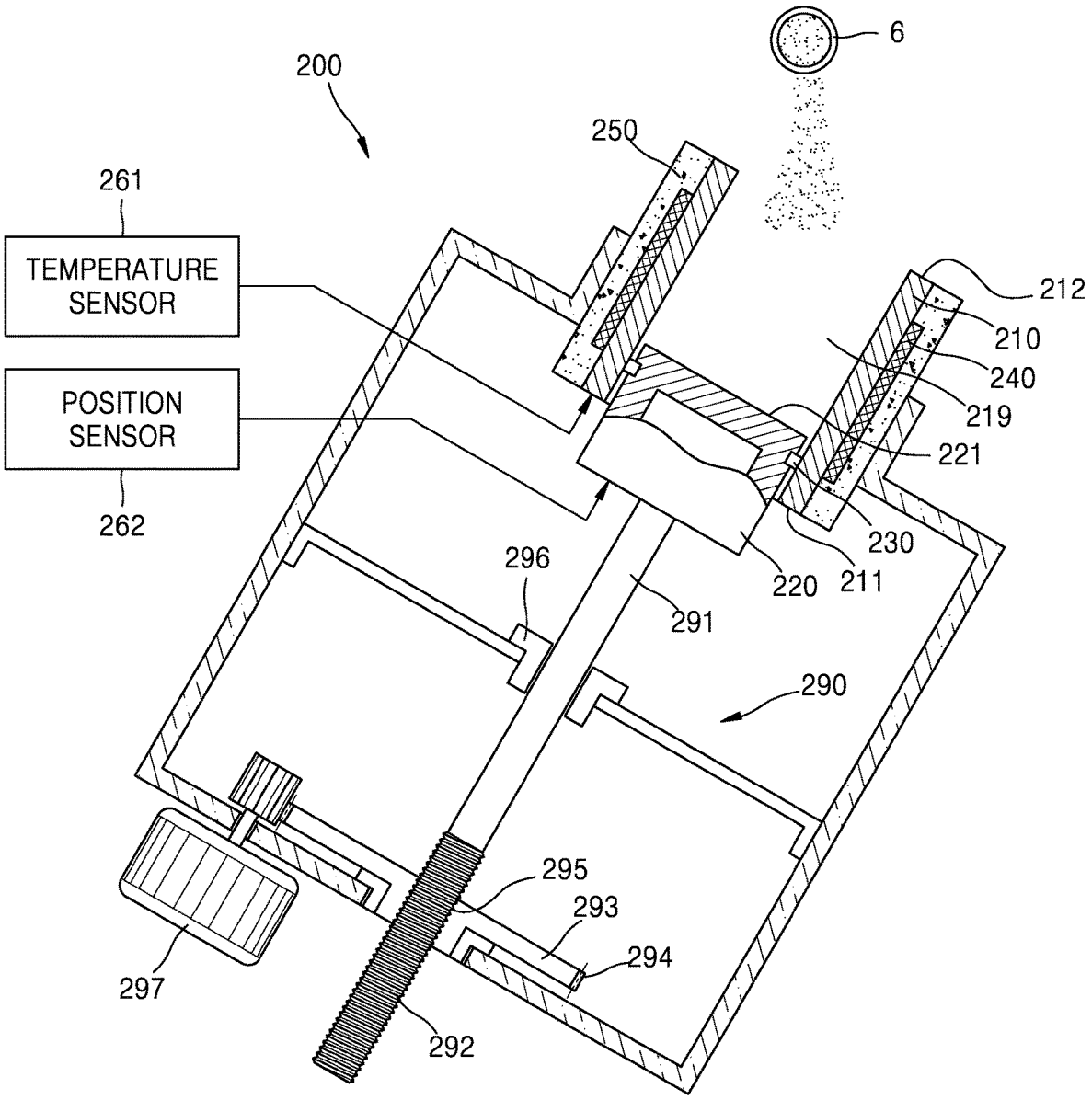
FIG. 6 is a schematic structural diagram of a waste toner pelletization device according to an example.

FIG. 6 is a schematic structural diagram of a waste toner pelletization device 200 according to an example.

Referring to FIG. 6, when the waste toner pelletization device 200 is installed in the image forming apparatus, the waste toner pelletization device 200 may be installed to be inclined at an acute angle with respect to the vertical direction. Waste toner may flow into the hollow portion 219 through the second end portion 212 of the container 210. According to the above structure, during the discharge of the waste toner pellet to the outside of the container 210, when the piston 220 exceeds the second end portion 212 of the container 210, the waste toner pellet may more easily slide out of the head surface 221 of the piston 220 and fall out of the container 210.

Figure 7:
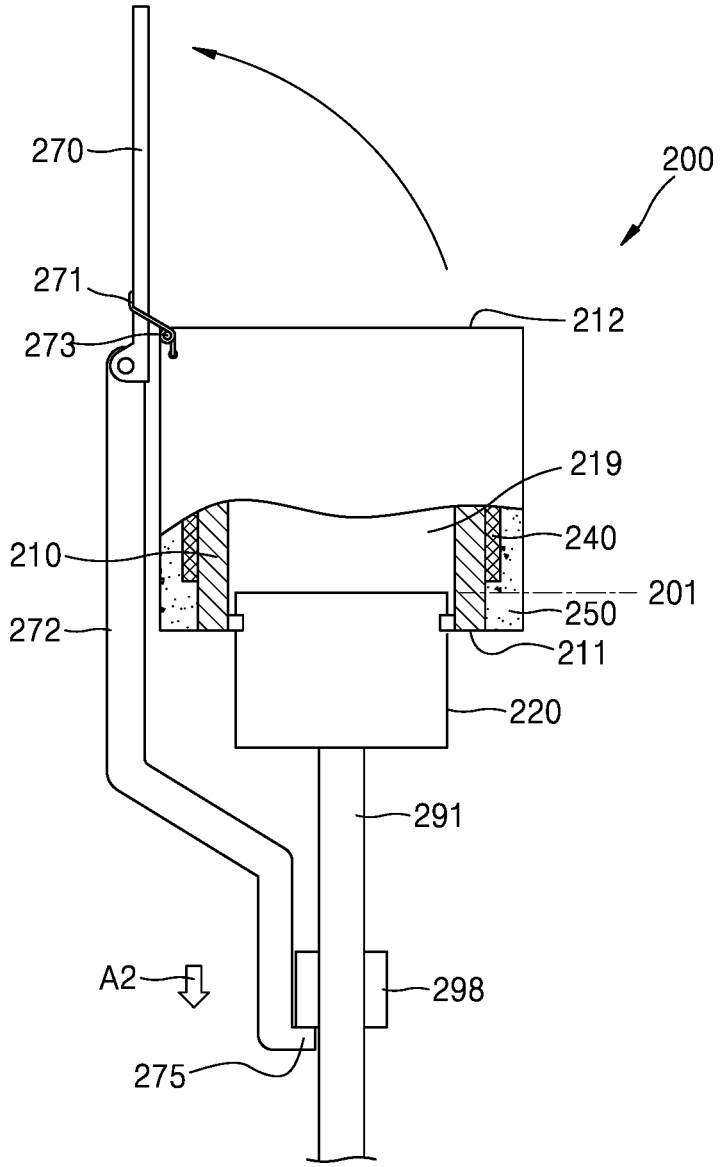
FIG. 7 is a schematic structural diagram illustrating a state in which a lid of a waste toner pelletization device is positioned in an open position according to an example.
Figure 8:
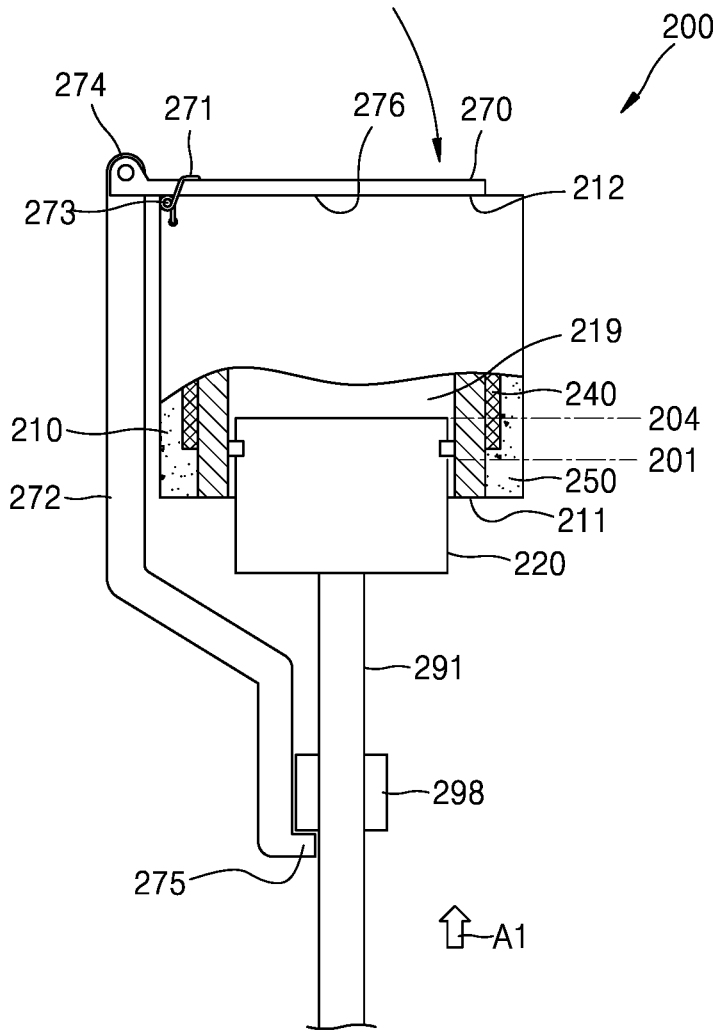
FIG. 8 is a schematic structural diagram illustrating a state in which a lid of a waste toner pelletization device is positioned in a closed position according to an example.

FIG. 7 is a schematic structural diagram illustrating a state in which a lid 270 of a waste toner pelletization device 200 is positioned in an open position according to an example. FIG. 8 is a schematic structural diagram illustrating a state in which a lid 270 of a waste toner pelletization device 200 is positioned in a closed position according to an example.

Referring to FIGS. 7 and 8, the waste toner pelletization device 200 may include the lid 270 switchable to a closed position (FIG. 8) blocking the second end portion 212 of the hollow portion 219 and switchable to an open position (FIG. 7) opening the second end portion 212 of the hollow portion 219, an elastic member 271 that applies an elastic force in a direction in which the lid 270 is positioned in the closed position, and a switching lever 272 connected with the piston 220 and the lid 270 to switch the lid 270 from the closed position to the open position in conjunction with a movement of the piston 220 to the first position 201. Although the driving unit 290 is omitted in FIGS. 7 and 8, the structure of the driving unit 290 may be the same as that shown in FIG. 3. The piston 220 shown in FIGS. 7 and 8 may include a head surface 221 inclined with respect to the moving direction of the piston 220 as shown in FIG. 5.

For example, the lid 270 may be rotated around a hinge 273. The hinge 273 may be provided in, for example, the container 210 and the heat insulating member 250. The elastic member 271 may be implemented by a torsion coil spring in which a winding portion thereof is inserted in the hinge 273 and one arm of the torsion coil spring is supported by the lid 270 and the other arm thereof is supported by the container 210 or the heat insulating member 250. One end portion 274 of the switching lever 272 is rotatably connected to the lid 270. For example, another end portion 275 of the switching lever 272 may interfere with a locking step 298 provided in the rod 291 depending on the position of the piston 220.

A bottom surface 276 of the lid 270 may be in contact with a waste toner viscous body having a high temperature, as described below. A release layer may be provided on the bottom surface 276 of the lid 270 such that the waste toner viscous body does not adhere to the bottom surface 276 of the lid 270.

For example, as shown in FIG. 8, when the piston 220 deviates from the first position 201, that is, in a state (e.g., a fourth position 204) in which the piston 220 is slightly moved from the first position 201 toward the second position 202, the other end portion 275 of the switching lever 272 is positioned on the rear side of the locking step 298, that is, an opposite side of the piston 220 based on the locking step 298, while being spaced apart from the locking step 298. The lid 270 is positioned in the closed position by the elastic force of the elastic member 271.

When the piston 220 is moved in the A2 direction, the other end portion 275 of the switching lever 272 is caught by the locking step 298. In this state, when the piston 220 is continued to be moved in the A2 direction, the switching lever 272 is moved in the A2 direction by the locking step 298. As shown in FIG. 7, the lid 270 is rotated around the hinge 273 to switch from the closed position to the open position. When the piston 220 reaches the first position, the lid 270 reaches the open position. The other end portion 275 of the switching lever 272 is maintained in a state of being caught by the locking step 298 by the elastic force of the elastic member 271. Accordingly, the lid 270 is maintained in the open position.

As the piston 220 is moved in the A1 direction to the fourth position 204 from the first position 201, the locking step 298 is moved in a direction spaced apart from the other end portion 275 of the switching lever 272 and the lid 270 is rotated from the open position to the closed position by the elastic force of the elastic member 271. When the piston 220 reaches the fourth position 204, the lid 270 reaches the closed position. When the piston 220 is moved beyond the fourth position 204 toward the second position 202, the locking step 298 is spaced apart from the other end portion 275 of the switching lever 272. The lid 270 is maintained in the closed position by the elastic force of the elastic member 271.

In a case where a pelletization process is not performed for a long time after waste toner is accommodated in the container 210, waste toner may be leaked from the container 210 when an impact is applied to the image forming apparatus. According to an example, when the pelletization process is not performed for a long time, the lid 270 is switched to the closed position by slightly moving the piston 220 from the first position 201 to a position toward the second position 202, for example, the fourth position 204. Accordingly, waste toner may be prevented from being leaked from the container 210.

Figure 9A:
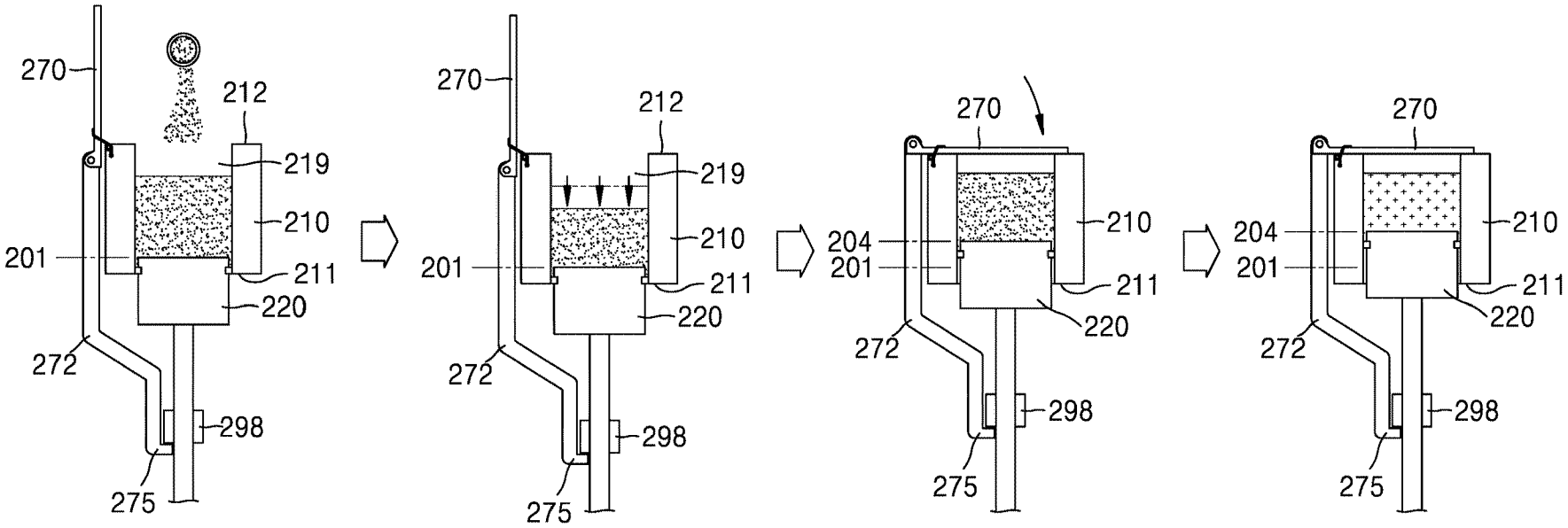
FIGS. 9A and 9B illustrate a waste toner pelletization method using the waste toner pelletization device shown in FIGS. 7 and 8 according to an example.
Figure 9B:
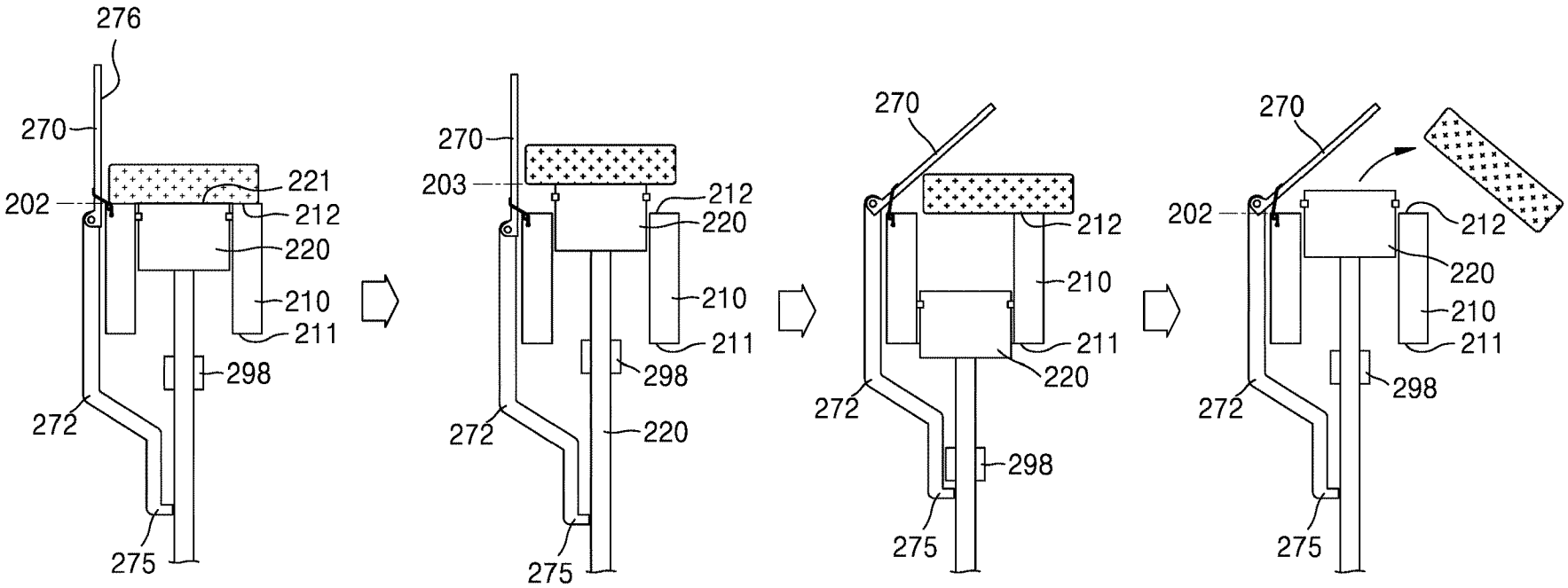

FIGS. 9A and 9B illustrate a waste toner pelletization method using the waste toner pelletization device 200 shown in FIGS. 7 and 8 according to an example.

An example waste toner pelletization method may include accommodating waste toner in the hollow portion 219 of the container 210, forming a waste toner viscous body by heating the waste toner in the hollow portion 219, forming a waste toner pellet by cooling the waste toner viscous body, and discharging the waste toner pellet. The accommodating of the waste toner in the hollow portion 219 may include opening the lid 270 to accommodate waste toner in the hollow portion 219 of the container 210 and closing the lid 270. The accommodating of the waste toner may further include preheating the waste toner before closing the lid 270. The discharging of the waste toner pellet may include separating the waste toner pellet from the second end portion 212 of the container 210, separating the waste toner pellet from the head surface 221 of the piston 220, and discharging the waste toner pellet to the outside of the container 210.

FIG. 9A illustrates accommodating waste toner in a hollow portion 219 of a container 210 and forming of a waste toner pellet by cooling a waste toner viscous body according to an example.

Referring to FIG. 9A, the lid 270 is positioned in the open position opening the second end portion 212 of the hollow portion 219 in conjunction with an operation of positioning the piston 220 in the first position 201 to allow waste toner to flow into the hollow portion 219 through the second end portion 212.

The controller 500 drives the motor 297 to position the piston 220 in the first position 201. As shown in FIG. 7, since the other end portion 275 of the switching lever 272 is in a state of being caught in the locking step 298, the lid 270 is positioned in the open position. Waste toner discharged from the waste toner outlet 6 is dropped into the hollow portion 219 through the second end portion 212 by gravity and is accommodated in the hollow portion 219.

The piston 220 is moved to the fourth position 204 between the first position 201 and the second position 202 such that the lid 270 is moved to the closed position blocking the second end portion 212 of the hollow portion 219 by the elastic force of the elastic member 271.

The controller 500 drives the motor 297 to move the piston 220 to the fourth position 204. The locking step 298 is moved in a direction away from the other end portion 275 of the switching lever 272 and the lid 270 is rotated toward the closed position by the elastic force of the elastic member 271. When the piston 220 reaches the fourth position, the lid 270 is positioned in the closed position.

Before moving the piston 220 to the fourth position 204, the controller 500 may drive the heater 240 to preheat the waste toner in the hollow portion 219. As described above, a preheating temperature may be greater than or equal to the glass transition temperature Tg. Particles of waste toner bind together and the volume is slightly reduced by preheating.

As described above, when the heater 240 is used to preheat the waste toner in the hollow portion 219 before moving the piston 220 to the fourth position 204, particles of waste toner bind together. Accordingly, the possibility of waste toner leaking through a gap between the piston 220 and the inner wall of the hollow portion 219 may be reduced in a process of moving the piston 220 to the fourth position 204.

The controller 500 uses the heater 240 to heat the waste toner in the hollow portion 219 to form the waste toner viscous body. When the temperature of the waste toner rises above the glass transition temperature Tg, the waste toner viscous body becomes viscous and particles of waste toner bind together to form the waste toner viscous body. The volume of the waste toner viscous body may be less than the volume of the waste toner in the hollow portion 219.

FIG. 9B illustrates forming of a waste toner pellet by cooling a waste toner viscous body and discharging the waste toner pellet according to an example.

Referring to FIG. 9B, the controller 500 drives the motor 297 to move the piston 220 to the second position 202 such that the waste toner viscous body is exposed to the second end portion 212 of the hollow portion 219. As the piston 220 approaches the second position 202, the waste toner viscous body contacts the bottom surface 276 of the lid 270 and pushes the lid 270. A release layer may be provided on the bottom surface 276 of the lid 270 such that the waste toner viscous body does not adhere to the bottom surface 276 of the lid 270, as described above. When the piston 220 reaches the second position 202, the lid 270 is switched to a position close to the open position. Although FIG. 9B illustrates that the lid 270 is spaced apart from the waste toner viscous body, the lid 270 may be in a state of contact with the waste toner viscous body.

The waste toner viscous body is exposed to the outside of the container 210. As described above, the waste toner viscous body is spread over the head surface 221 of the piston 220 and supported by the second end portion 212 of the hollow portion 219. In this state, the waste toner viscous body is cooled for a predetermined cooling time. As the waste toner viscous body solidifies, the waste toner viscous body becomes the waste toner pellet. The waste toner pellet is attached to the head surface 221 of the piston 220 and the second end portion 212 of the hollow portion 219.

The controller 500 drives the motor 297 to move the piston 220 to the third position 203 beyond the second end portion 212 of the container 210. The waste toner pellet is separated from the second end portion 212 of the container 210 and moved together with the piston 220.

The controller 500 drives the motor 297 to move the piston 220 from the third position 203 toward the first position 201 through the second position 202. When the piston 220 reaches the second position 202, the waste toner pellet is caught by the second end portion 212 of the container 210 and only the piston 220 is moved toward the first position 201. The waste toner pellet is separated from the head surface 221 of the piston 220. As the lid 270 is rotated to the closed position by the elastic force of the elastic member 271, the waste toner pellet is pushed out of the container 210 and the waste toner pellet may be in a state of partially being caught by the second end portion 212 of the container 210.

The controller 500 drives the motor 297 to move the piston 220 to the position beyond the second end portion 212 of the container 210. When the piston 220 passes through the second position 202, the waste toner pellet may be dropped to the outside of the container 210 by being pushed by the piston 220 and the lid 270, which is rotated to the closed position.

Figure 10:
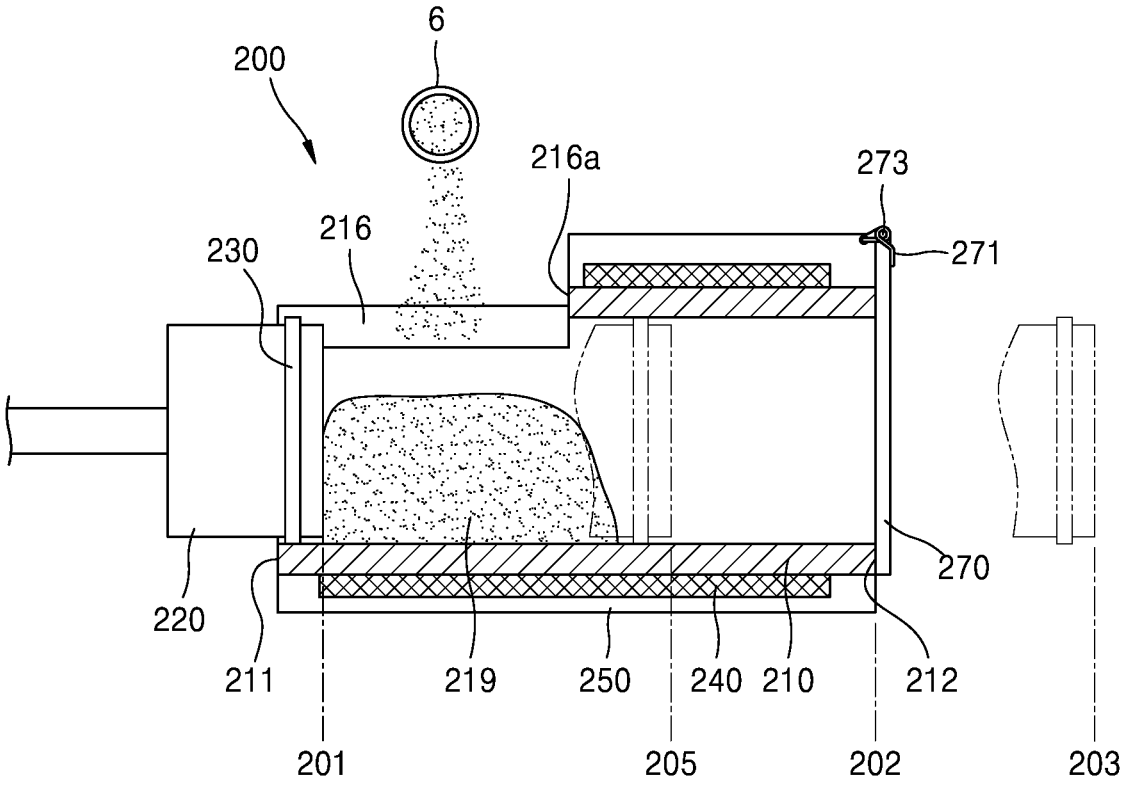
FIG. 10 is a schematic structural diagram of a waste toner pelletization device according to an example.

FIG. 10 is a schematic structural diagram of a waste toner pelletization device 200 according to an example.

Referring to FIG. 10, the waste toner pelletization device 200 may be arranged in a lateral direction. The waste toner pelletization device 200 may include an inlet opening 216 opened in a sidewall of the container 210 such that waste toner may flow into the hollow portion 219 as the piston 220 is positioned in the first position 201. The piston 220 includes a fifth position 205 between an end portion 216*a* of the inlet opening 216, which is toward the second end portion 212 of the container 210 and the second position 202. The heater 240 may apply heat to the container 210 such that the waste toner in the hollow portion 219 becomes a waste toner viscous body in a state in which the piston 220 is positioned in the fifth position 205.

The inlet opening 216 is positioned below the waste toner outlet 6. The lid 270 is switchable between the open position opening the second end portion 212 of the container 210 and the closed position blocking the second end portion 212 of the container 210. For example, the lid 270 may be rotated around the hinge 273. The hinge 273 may be provided in, for example, the container 210 and the heat insulating member 250. The elastic member 271 may be implemented by a torsion coil spring in which a winding portion thereof is inserted in the hinge 273 and one arm of the torsion coil spring is supported by the lid 270 and the other arm thereof is supported by the container 210 or the heat insulating member 250.

Although the driving unit 290 is omitted in FIG. 10, the structure of the driving unit 290 may be the same as that shown in FIG. 3. The piston 220 shown in FIG. 10 may include a head surface 221 inclined with respect to the moving direction of the piston 220 as shown in FIG. 5.

Figure 11A:
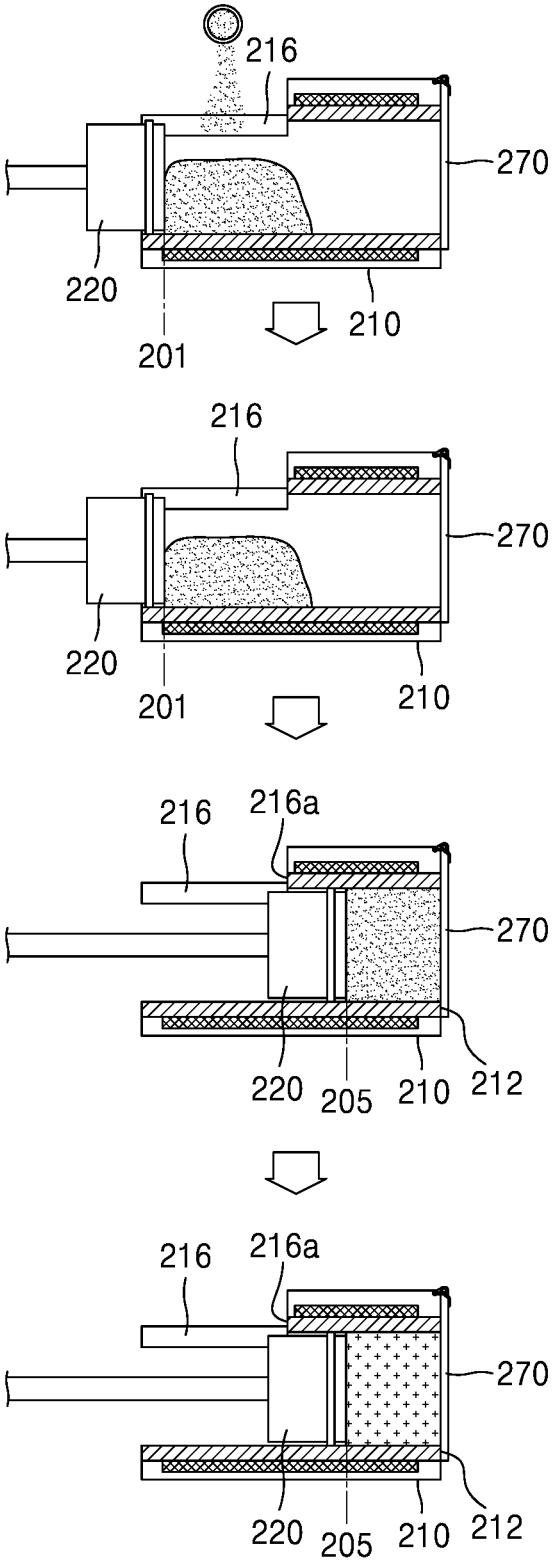
FIGS. 11A and 11B illustrate a waste toner pelletization method using the waste toner pelletization device shown in FIG. 10 according to an example.
Figure 11B:
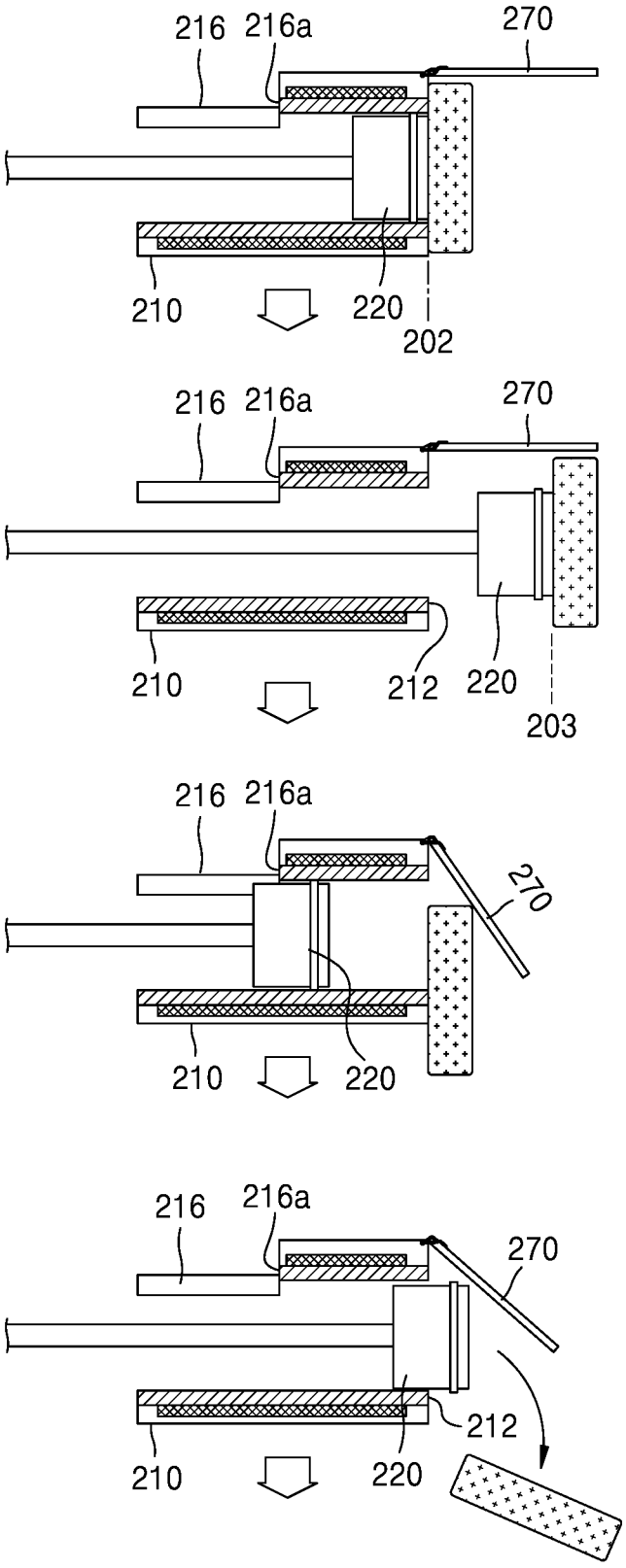

FIGS. 11A and 11B illustrate a waste toner pelletization method using the waste toner pelletization device 200 shown in FIG. 10 according to an example. Since the waste toner pelletization method of the present example is similar to the example of the waste toner pelletization method shown in FIGS. 9A and 9B, differences thereof are described.

FIG. 11A illustrates accommodating of waste toner in a hollow portion 219 of a container 210 and forming of a waste toner viscous body according to an example.

The accommodating of waste toner in the hollow portion 219 of the container 210 may include positioning the lid 270 in the closed position blocking the second end portion 212 of the container 210 by the elastic force of the elastic member 271, accommodating the waste toner in the hollow portion 219 through the inlet opening 216 opened in the sidewall of the container 210 installed in the lateral direction, and moving the piston 220 to the fifth position 205 between the end portion 216*a* of the inlet opening 216 which is toward the second end portion 212 of the container 210 and the second position 202.

Referring to FIG. 11A, the controller 500 drives the motor 297 to position the piston 220 in the first position 201. The lid 270 is maintained in the closed position by the elastic force of the elastic member 271. Waste toner discharged from the waste toner outlet 6 is dropped into the hollow portion 219 through the inlet opening 216 by its weight and is accommodated in the hollow portion 219.

The controller 500 drives the motor 297 to move the piston 220 to the fifth position 205. The fifth position 205 is a position where the piston 220 is beyond the end portion 216*a* of the inlet opening 216. The controller 500 uses the heater 240 to heat the waste toner in the hollow portion 219 to form the waste toner viscous body.

Before moving the piston 220 to the fifth position 205, the waste toner in the hollow portion 219 may be preheated. The controller 500 may drive the heater 240 to preheat the waste toner to the glass transition temperature Tg or more. Particles of the waste toner bind together and the volume is slightly reduced by preheating. Accordingly, the possibility of waste toner leaking through the gap between piston 220 and the inner wall of the hollow portion 219 may be reduced in a process of moving the piston 220 to the fifth position 205 to be described below.

FIG. 11B illustrates forming of a waste toner pellet by cooling a waste toner viscous body and discharging of the waste toner pellet according to an example.

Referring to FIG. 11B, the controller 500 drives the motor 297 to move the piston 220 to the second position 202 such that the waste toner viscous body is exposed to the second end portion 212 of the hollow portion 219. When the piston 220 reaches the second position 202, the lid 270 is pushed by the waste toner viscous body and switched to the open position and the waste toner viscous body is completely exposed to the outside of the container 210 and is supported by the head surface 221 of the piston 220 and the second end portion 212 of the container 210. In this state, the waste toner viscous body is cooled for a predetermined cooling time. The waste toner pellet is attached to the head surface 221 of the piston 220 and the second end portion 212 of the hollow portion 219.

The controller 500 drives the motor 297 to move the piston 220 to the third position 203 beyond the second end portion 212 of the container 210. The waste toner pellet is separated from the second end portion 212 of the container 210. The controller 500 drives the motor 297 to move the piston 220 from the third position 203 toward the first position 201 through the second position 202. In the process, the waste toner pellet is caught by the second end portion 212 of the container 210 and only the piston 220 is moved toward the first position 201 such that the waste toner pellet is separated from the head surface 221 of the piston 220. As the lid 270 is rotated to the closed position by the elastic force of the elastic member 271, the waste toner pellet is pushed out of the container 210 and the waste toner pellet may be in a state of partially being caught by the second end portion 212 of the container 210. The controller 500 drives the motor 297 to move the piston 220 back to the position beyond the second end portion 212 of the container 210. When the piston reaches the second position 202, the waste toner pellet is dropped to the outside of the container 210 by being pushed by the piston 220 and the lid 270, which is rotated to the closed position.

As described above, since the waste toner pelletization device 200 shown in FIG. 10 is installed in the lateral direction, the waste toner pellet may be separated from the container 210 and dropped by its weight.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. An image forming apparatus comprising:

a printing unit to print an image on a print medium using toner;

a container having a hollow portion to accommodate waste toner discharged from the printing unit;

a heater to apply heat to the container such that the waste toner becomes a waste toner viscous body; and a piston inserted in the hollow portion of the container movable between a first position blocking a first end portion of the hollow portion, a second position exposing the waste toner viscous body to a second end portion of the hollow portion to cool the waste toner viscous body to become a waste toner pellet, and a third position beyond the second position to separate the waste toner pellet from the second end portion of the hollow portion.

2. The image forming apparatus of claim 1, wherein the waste toner pellet in the second position is supported on the second end portion of the hollow portion and a head surface of the piston.

3. The image forming apparatus of claim 1, further comprising a sealing member installed on the piston to prevent waste toner leakage through a gap between the piston and an inner wall of the hollow portion.

4. The image forming apparatus of claim 1, wherein a release coating layer is provided on a head surface of the piston.

5. The image forming apparatus of claim 1, wherein an upper end portion comprising a head surface of the piston comprises a releasable elastic body such that the upper end portion comprising the head surface of the piston is in contact with an inner wall of the hollow portion.

6. The image forming apparatus of claim 1, wherein a head surface of the piston is inclined with respect to a moving direction of the piston.

7. The image forming apparatus of claim 1, wherein the container has a heating region in which the heater is installed and a non-heating region in which the heater is not installed near the second end portion of the hollow portion.

8. The image forming apparatus of claim 1, further comprising:

a lid switchable between an open position opening the second end portion of the hollow portion and a closed position blocking the second end portion of the hollow portion;

an elastic member to apply an elastic force to the lid in a direction in which the lid is positioned in the closed position; and a switching lever connected to the piston and the lid to switch the lid between the closed position and the open position in conjunction with a movement of the piston to the first position.

9. The image forming apparatus of claim 1, further comprising:

an inlet opening opened in a sidewall of the container such that the waste toner flows into the hollow portion when the piston is positioned in the first position;

wherein the piston has a fifth position between an end portion of the inlet opening, which is toward the second end portion of the hollow portion, and the second position; and wherein the heater is to apply heat to the container such that the waste toner becomes the waste toner viscous body in a state in which the piston is positioned in the fifth position.

10. The image forming apparatus of claim 9, further comprising:

a lid switchable between an open position opening the second end portion of the hollow portion and a closed position blocking the second end portion of the hollow portion; and an elastic member to apply an elastic force to the lid in a direction in which the lid is positioned in the closed position.

11. A waste toner pelletization method of an image forming apparatus, the method comprising:

positioning a piston in a first position adjacent to a first end portion of a hollow portion of a container and accommodating waste toner discharged from a printing unit in the hollow portion;

forming a waste toner viscous body by heating the waste toner;

moving the piston to a second position to support the waste toner viscous body at a second end portion of the hollow portion and to cool the waste toner viscous body to form a waste toner pellet;

moving the piston to a third position beyond the second end portion of the hollow portion and separating the waste toner pellet from the second end portion of the hollow portion;

moving the piston from the third position toward the first position through the second position and separating the waste toner pellet from a head surface of the piston; and moving the piston to a position beyond the second end portion of the hollow portion and discharging the waste toner pellet out of the container.

12. The method of claim 11, further comprising:

positioning a lid in an open position opening the second end portion of the hollow portion in conjunction with a movement positioning the piston in the first position to allow the waste toner to flow into the hollow portion through the second end portion of the hollow portion; and, before the forming of the waste toner viscous body, moving the piston to a fourth position between the first position and the second position and allowing the lid to be moved to a closed position blocking the second end portion of the hollow portion by an elastic force of an elastic member.

13. The method of claim 12, further comprising, before moving the piston to the fourth position, preheating the waste toner.

14. The method of claim 11, wherein the accommodating of the waste toner in the hollow portion comprises:

positioning a lid to a closed position blocking the second end portion of the hollow portion by an elastic force of an elastic member and accommodating the waste toner in the hollow portion through an inlet opening opened in a sidewall of the container installed in a lateral direction; and moving the piston to a fifth position between an end portion of the inlet opening, which is toward the second end portion of the hollow portion, and the second position.

15. The method of claim 14, further comprising, before moving the piston to the fifth position, preheating the waste toner.

* * * * *